US011359254B2

(12) United States Patent
Reinartz

(10) Patent No.: US 11,359,254 B2
(45) Date of Patent: Jun. 14, 2022

(54) HEAT TREATMENT METHOD AND HEAT TREATMENT DEVICE

(71) Applicant: SCHWARTZ GMBH, Simmerath (DE)

(72) Inventor: Andreas Reinartz, Monschau (DE)

(73) Assignee: SCHWARTZ GMBH, Simmerath (DE)

( * ) Notice: Subject to any disclaimer, the term of this patent is extended or adjusted under 35 U.S.C. 154(b) by 250 days.

(21) Appl. No.: 16/072,631

(22) PCT Filed: Jan. 25, 2017

(86) PCT No.: PCT/EP2017/051514
§ 371 (c)(1),
(2) Date: Jul. 25, 2018

(87) PCT Pub. No.: WO2017/129603
PCT Pub. Date: Aug. 3, 2017

(65) Prior Publication Data

US 2019/0032163 A1 Jan. 31, 2019

(30) Foreign Application Priority Data

Jan. 25, 2016 (DE) ..... 10 2016 201 024.7

(51) Int. Cl.
*C21D 9/00* (2006.01)
*C21D 1/19* (2006.01)
(Continued)

(52) U.S. Cl.
CPC ..... *C21D 9/0062* (2013.01); *C21D 1/19* (2013.01); *C21D 1/667* (2013.01); *C21D 1/673* (2013.01);
(Continued)

(58) Field of Classification Search
CPC ..... C21D 9/0062; C21D 1/19; C21D 1/00; C21D 8/005; C21D 1/667; C21D 1/673;
(Continued)

(56) References Cited

U.S. PATENT DOCUMENTS

2010/0139821 A1* 6/2010 Giefers ..... C22C 38/26 148/648
2012/0091758 A1* 4/2012 Zimmermann ..... C22C 1/02 296/193.06
(Continued)

FOREIGN PATENT DOCUMENTS

CN 103498105 A 1/2014
DE 102008021492 7/2009
(Continued)

OTHER PUBLICATIONS

EP2548975A1 English translation by machine. (Year: 2020).*
(Continued)

*Primary Examiner* — Robert S Jones, Jr.
*Assistant Examiner* — Jiangtian Xu
(74) *Attorney, Agent, or Firm* — Occhiuti & Rohlicek LLP

(57) ABSTRACT

Disclosed are implementations for heat treatment of steel components. In one or more first regions of a steel component, a predominantly austenitic structure can be adjusted, from which, by way of quenching, a mainly martensitic structure is educible. In one or more second regions of the steel component, there is a mainly bainitic structure, wherein the metal component is initially heated in a first furnace to
(Continued)

Figure 1:
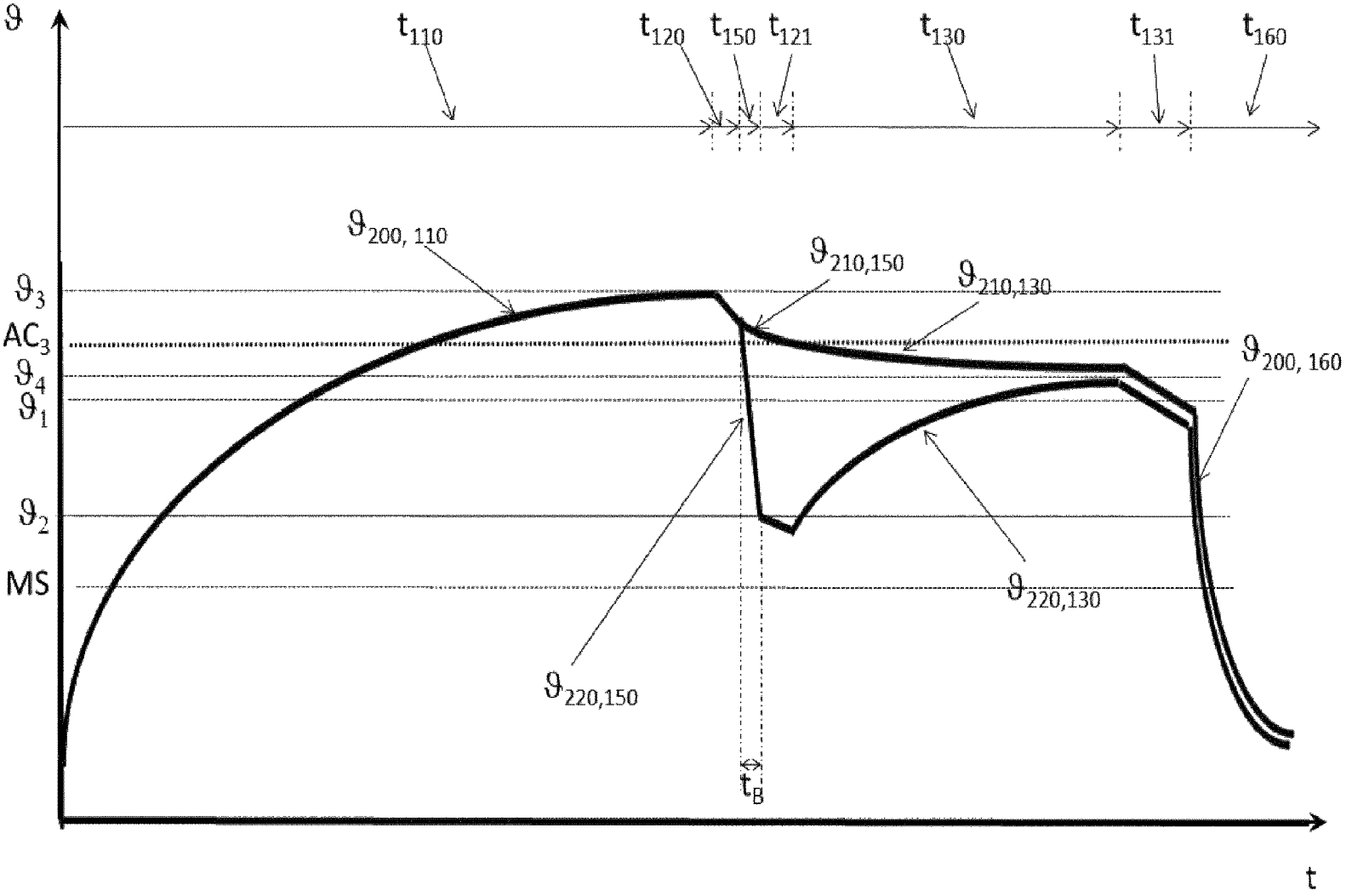

a temperature above the Ac3 temperature. Subsequently, the steel component is transferred into a treatment station, wherein the steel component can cool down during the transfer. In the treatment station, the one or more second regions of the steel component are cooled down to a cooling stop temperatures $\vartheta_2$ during a treatment period. Subsequently, said metal component is transferred to a second furnace, wherein the temperature of the one or more second regions increases again to a temperature below the Ac3 temperature.

5 Claims, 7 Drawing Sheets

(51) Int. Cl.
*C21D 1/673* (2006.01)
*C21D 8/00* (2006.01)
*C21D 1/667* (2006.01)

(52) U.S. Cl.
CPC ..... *C21D 8/005* (2013.01); *C21D 9/0068* (2013.01); *C21D 2211/001* (2013.01); *C21D 2211/002* (2013.01); *C21D 2211/008* (2013.01); *C21D 2221/00* (2013.01)

(58) Field of Classification Search
CPC ..... C21D 9/0068; C21D 2211/001; C21D 2211/002; C21D 2211/008; C21D 2221/00
See application file for complete search history.

(56) References Cited

U.S. PATENT DOCUMENTS

| | | | | |
|---|---|---|---|---|
| 2013/0160906 | A1 | 6/2013 | Bake et al. | |
| 2014/0076470 | A1* | 3/2014 | Zhu | C21D 8/0231 148/621 |
| 2014/0345753 | A1 | 11/2014 | Bors | |

FOREIGN PATENT DOCUMENTS

| | | | | |
|---|---|---|---|---|
| DE | 102010048209 | | 1/2012 | |
| DE | 102010049205 | | 4/2012 | |
| DE | 102013010946 | B3 | 12/2014 | |
| DE | 102014201259 | | 7/2015 | |
| EP | 2548975 | | 1/2013 | |
| EP | 2548975 | A1 * | 1/2013 | C21D 1/20 |
| GN | 103173606 | A | 6/2013 | |
| WO | 2010150683 | A1 | 12/2010 | |

OTHER PUBLICATIONS

Chinese Office Action dated May 15, 2020 in CN Application No. 2017800082215.
Japanese Office Action dated Oct. 27, 2020 in JP Application No. 2018-538675.
Chinese Office Action dated Nov. 9, 2020 in CN Application No. 2017800082215.

* cited by examiner

HEAT TREATMENT METHOD AND HEAT TREATMENT DEVICE

CROSS REFERENCE TO RELATED APPLICATIONS

This application is a National Phase under 35 U.S.C. 371 of International Application No. PCT/EP2017/051514 filed on Jan. 25, 2017, which claims priority to German Application No. 10 2016 201 024.7 filed Jan. 25, 2016, the contents of which are hereby incorporated by reference in their entirety.

The invention relates to a method and to a device for targetedly heat-treating individual zones of a steel component.

Several applications in various technical industries require high-strength sheet metal parts having a low part weight. For example, the vehicle industry aims to reduce fuel consumption of motor vehicles and to decrease $CO_2$ emissions, but to increase occupant safety at the same time. The need for vehicle body components that have a favorable ratio of strength to weight has therefore increased significantly. These components include in particular A and B columns, side-impact protection supports in doors, sills, frame parts, bumpers, crossmembers for the floor and roof and front and rear longitudinal supports. In modern motor vehicles, the body-in-white comprising a safety cage usually consists of a hardened steel sheet having a strength of approximately 1,500 MPa. In this case, steel sheets coated with several layers of Al—Si are used. The process of so-called press-hardening has been developed in order to produce a component from hardened sheet steel. In this case, steel sheets are first heated to the austenite temperature, then placed in a press die, quickly shaped and rapidly quenched to less than the martensite start temperature by the water-cooled die. A hard, strong martensite structure having a strength of approximately 1,500 MPa is thus produced. However, the elongation at break of a steel sheet hardened in this way is low. The kinetic energy of an impact therefore cannot be adequately converted into deformation heat.

It is therefore desirable for the automobile industry for it to be possible to produce vehicle body components that comprise a plurality of different elongation and strength zones within the component, so that a component has rather strong regions (called first regions in the following) and rather extensible regions (called second regions in the following). On the one hand, components having a high strength are in principle desirable for obtaining components that can be highly mechanically loaded and have a low weight. On the other hand, high-strength components are also intended to be able to comprise partially soft regions. This allows for the desired, partially increased deformability in the event of a crash. Only in this way can the kinetic energy of an impact be reduced, and the acceleration forces acting on both occupants and the rest of the vehicle are therefore minimized. In addition, modern joining methods require softened points that allow the same or different materials to be joined. Lock seams, crimp connections or riveted connections that require deformable regions in the component have to be used, for example.

In this case, the demands that are generally placed on a production system should still be taken into consideration: the press-hardening system should therefore not encounter any cycle time losses; the entire system should be used in an unrestricted and general manner and quick, product-specific modification of said system should be possible. The process should be robust and economical, and the production system should only require a minimal amount of space. The component should have a high degree of shape and edge accuracy.

In all known methods, the component is targetedly heat-treated in a time-consuming treatment step, which substantially influences the cycle time of the entire heat-treatment device.

Therefore, the object of the invention is to provide a method and a device for targetedly heat-treating individual zones of a steel component, whereby regions of varying hardness and ductility can be produced that minimize the influence of said treatment step on the cycle time of the overall heat-treatment device.

According to the invention, this object is achieved by a method having the features of independent claim 1. Advantageous developments of the method can be found in dependent claims 2 to 6. The object is also achieved by a device according to claim 8. Advantageous embodiments of the device can be found in sub-claims 7 to 15.

The steel component is first heated to above the austenitizing temperature Ac3 so that the structure can be fully transformed into austenite. In a subsequent curing process, for example the press-hardening process, rapid quenching is then carried out such that a predominantly martensitic structure is formed and strengths of approximately 1,500 MPa are achieved. The structure is advantageously quenched from the fully austenitized structure in this case. For this purpose, said structure has to be cooled at at least the lower critical cooling speed no later than once the temperature has fallen below the structure transformation start temperature $\vartheta_1$, at which structure transformations can begin. For example, for the material 22MnB5 that is usually used for press-hardening, approximately 660° C. should be considered to be limit $\vartheta_1$. Although an at least partially martensitic structure can still be produced when quenching begins at lower temperatures, reduced component strength should be expected in this region.

In the press-hardening method, this temperature profile is conventional for fully hardened components in particular.

A second region or a plurality of second regions is/are first likewise heated to above the austenitizing temperature Ac3 so that the structure can be fully transformed into austenite. It is then cooled to a cooling stop temperature $\vartheta_2$ as quickly as possible within a treatment time $t_B$. The martensite start temperature for 22MnB5 is, for example, approximately 410° C. A slight variation in temperature ranges below the martensite start temperature is also possible. The structure is no longer rapidly cooled and so a predominantly bainitic structure is formed. This structure transformation does not happen immediately, but requires a treatment time. The transformation is exothermic. If this transformation were able to take place in heated environments having a similar temperature to the component temperature present at the end of the cooling process, the cooling stop temperature $\vartheta_2$, it would be possible to clearly identify the temperature increase in the component caused by the recalescence. By setting the cooling speed and/or the temperature to which the structure is cooled, as well as the dwell time until the component is pressed out, it is in principle possible to set the desired strength and elongation values, which lie between the maximum achievable strength of the structure in the first region and the values of the untreated component. Tests have shown that inhibiting the temperature increase as a result of the recalescence by additional forced cooling of the component is rather disadvantageous for the elongation values achievable.

Isothermally keeping the structure at the cooling temperature therefore does not appear to be advantageous. On the contrary, re-heating is advantageous.

In one embodiment, the second region or the second regions is/are additionally actively heated in this phase. Thermal radiation may be used for this, for example.

In one embodiment, the cooling stop temperature $\vartheta_2$ is selected to be above the martensite start temperature $M_S$.

In an alternative embodiment, the cooling stop temperature $\vartheta_2$ is selected to be below the martensite start temperature $M_S$.

The first and second regions are heat-treated differently in principle, whereby treatment of the second region or the second regions is primarily dependent on the treatment duration. According to the invention, second regions are partially cooled to the cooling stop temperature $\vartheta_2$ within a treatment time $t_B$ of a few seconds in a first furnace in order to achieve the austenitizing temperature downstream treatment station. In this treatment station, the first region or the first regions is/are not specially treated.

The treatment station can optionally also be heated for this purpose. For this, heat can be added by means of convection or thermal radiation, for example.

According to the invention, the components are conveyed to a second furnace after a few seconds in the treatment station, which can also comprise a positioning device that ensures that the different regions are accurately positioned, which second furnace preferably does not comprise any special devices for treating the different regions differently. A furnace temperature $\vartheta_4$, i.e. a substantially homogenous temperature $\vartheta_4$ in the entire furnace chamber, is merely set and generally lies between the austenitizing temperature Ac3 and the minimum quenching temperature. An advantageous temperature is, for example, between 660° C. and 850° C. The different regions therefore approach the temperature $\vartheta_4$ of the second furnace. Provided that the drop in temperature in the first regions during the period in which they are in the treatment station is small enough for the temperature of the second regions not to fall below the temperature $\vartheta_4$ of the second furnace, the temperature profile of the first type of regions approaches the temperature $\vartheta_4$ of the second furnace from above. In an advantageous embodiment, the minimum cooling temperature, i.e. the cooling stop temperature $\vartheta_2$ in the second type of regions is lower than the temperature $\vartheta_4$ selected for the second furnace. In this respect, the temperature profile of the second regions approaches the temperature $\vartheta_4$ of the second furnace from below. This process causes the temperatures of the regions treated in different ways to approach one another.

The first region or the first regions dissipate heat in the second furnace when they reach the second furnace at a temperature that is higher than the internal temperature $\vartheta_4$ of the second furnace. The second region or the second regions absorb heat in the second furnace. Overall, this only requires a relatively small amount of heating power in the second furnace. During the production process, additional heating can optionally be omitted altogether. This treatment step is therefore particularly energy-efficient.

A continuous furnace or a batch furnace, for example a chamber furnace, can be provided as the first furnace, for example. Continuous furnaces generally have a larger capacity and are particularly well suited for mass production, since they can be charged and operated without a large amount of effort.

According to the invention, the treatment station comprises a device for rapidly cooling one or more second regions of the steel component. In a preferred embodiment, the device comprises a nozzle for blowing a gaseous fluid, for example air or a protective gas, such as nitrogen, into the second region or the second regions of the steel component.

In another advantageous embodiment of the method, a gaseous fluid is blown into the second region or the second regions, water being admixed to the gaseous fluid, for example in atomized form. For this purpose, in an advantageous embodiment the device comprises one or more atomizing nozzles. By blowing the gaseous fluid that is mixed with water into said second region or second regions, a larger amount of heat is dissipated therefrom. Evaporating the water on the steel component leads to greater heat dissipation and energy transmission.

A continuous furnace or a batch furnace, for example a chamber furnace, can also be provided as the second furnace, for example.

In another embodiment, the second region or the second regions is/are cooled by means of thermal conduction, for example by being brought into contact with a punch or a plurality of punches, which has/have a much lower temperature than the steel component. For this purpose, the punch can be made of a material that is thermally conductive and/or can be cooled either directly or indirectly. A combination of cooling methods is also conceivable.

It has proven advantageous for measures to be taken in the treatment station in order to reduce the drop in temperature of the first region or the first regions. Such measures can be attaching a thermal radiation reflector and/or insulating surfaces of the treatment station in the region of the first region or the first regions, for example.

By means of the method according to the invention and the heat-treatment device according to the invention, steel components comprising one or more first and/or second regions in each case, which may also have a complex shape, can be economically imprinted with a corresponding temperature profile, since the different regions can be quickly brought to the required processing temperatures with sharp contours. Clearly contoured boundaries of the individual regions can be formed between the two regions and the small temperature difference minimizes the warpage of the components. Small expansions in the temperature of the component have an advantageous effect during further processing in the press. In a continuous furnace, the dwell times required for the second region or the second regions can, for example, be established on the basis of the length of the component by setting the conveying speed and the dimensions of the furnace length. The cycle time of the heat-treatment device is thereby minimally affected, or even not at all.

According to the invention, the method shown and the heat-treatment device according to the invention make it possible to set virtually any number of second regions, which can additionally each have strength and expansion values within a steel component that still differ from one another. The geometry selected for the portions is also freely selectable. Punctiform or linear regions are conceivable, as are regions having a large surface area, for example. The position of the regions does not matter either. The second regions can be completely enclosed by first regions or can be located at the edge of the steel component. All-over treatment is even conceivable. For the purpose of the method according to the invention of targetedly heat-treating individual zones of a steel component, the steel component does not need to be oriented in any specific way with respect to the direction of flow. In any case, the number of steel components treated at the same time is limited by the press-hardening die or the materials-handling technology of the entire heat-treatment device. Application of the method to steel components that have already been preformed is also possible. The three-dimensionally molded surfaces of steel components that have already been preformed merely means that the formation of the mating surfaces involves a greater degree of design complexity.

Furthermore, it is advantageous for it to be possible to adapt heat-treatment systems that already exist to the method according to the invention. For this purpose, in a conventional heat-treatment device comprising just one furnace, only the treatment station and the second furnace have to be installed downstream of said furnace. Depending on the design of the furnace provided, it is also possible to divide said furnace up so that the first and the second furnace are produced from the initial one furnace.

Figure 2:
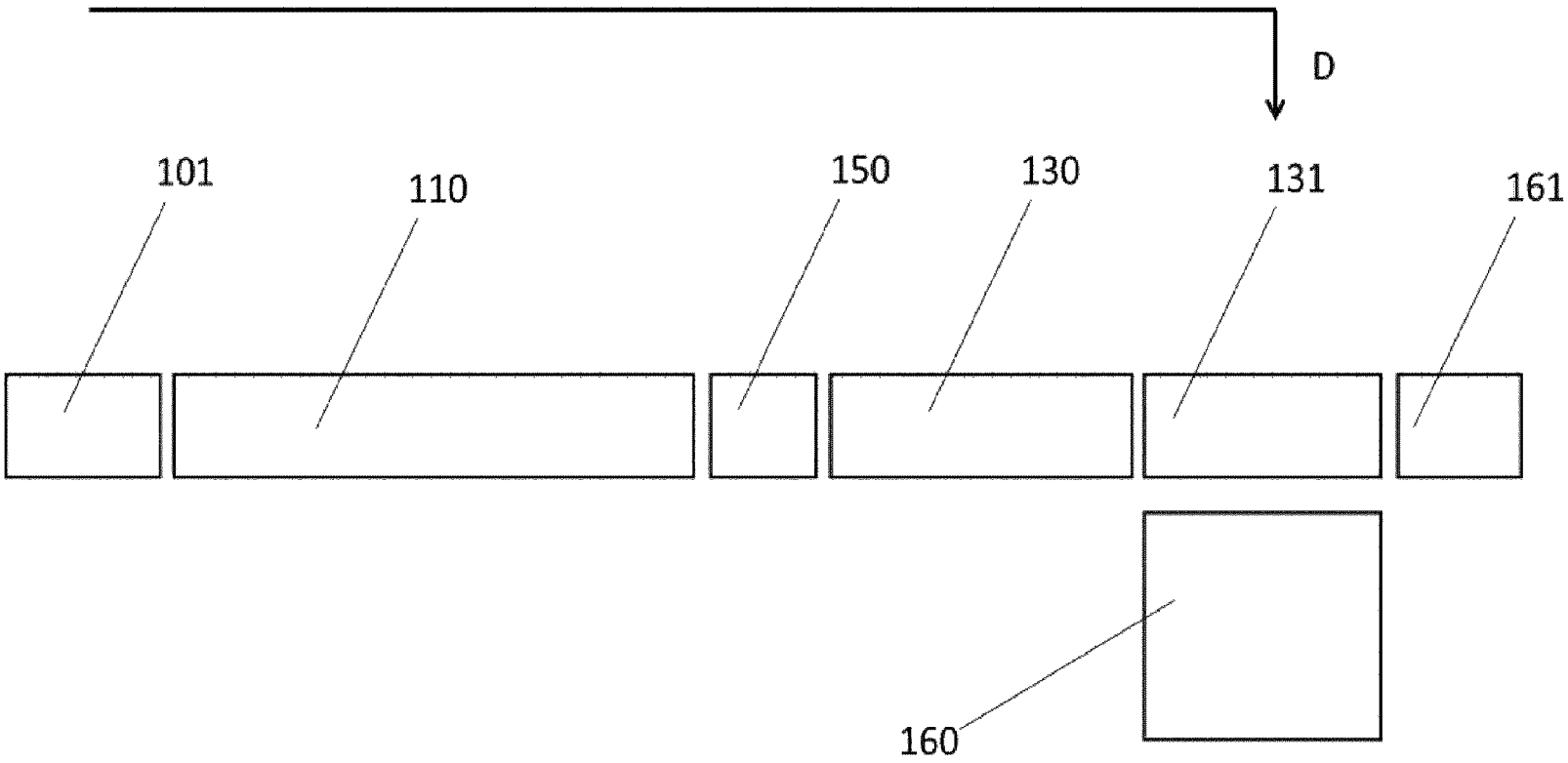
Figure 3:
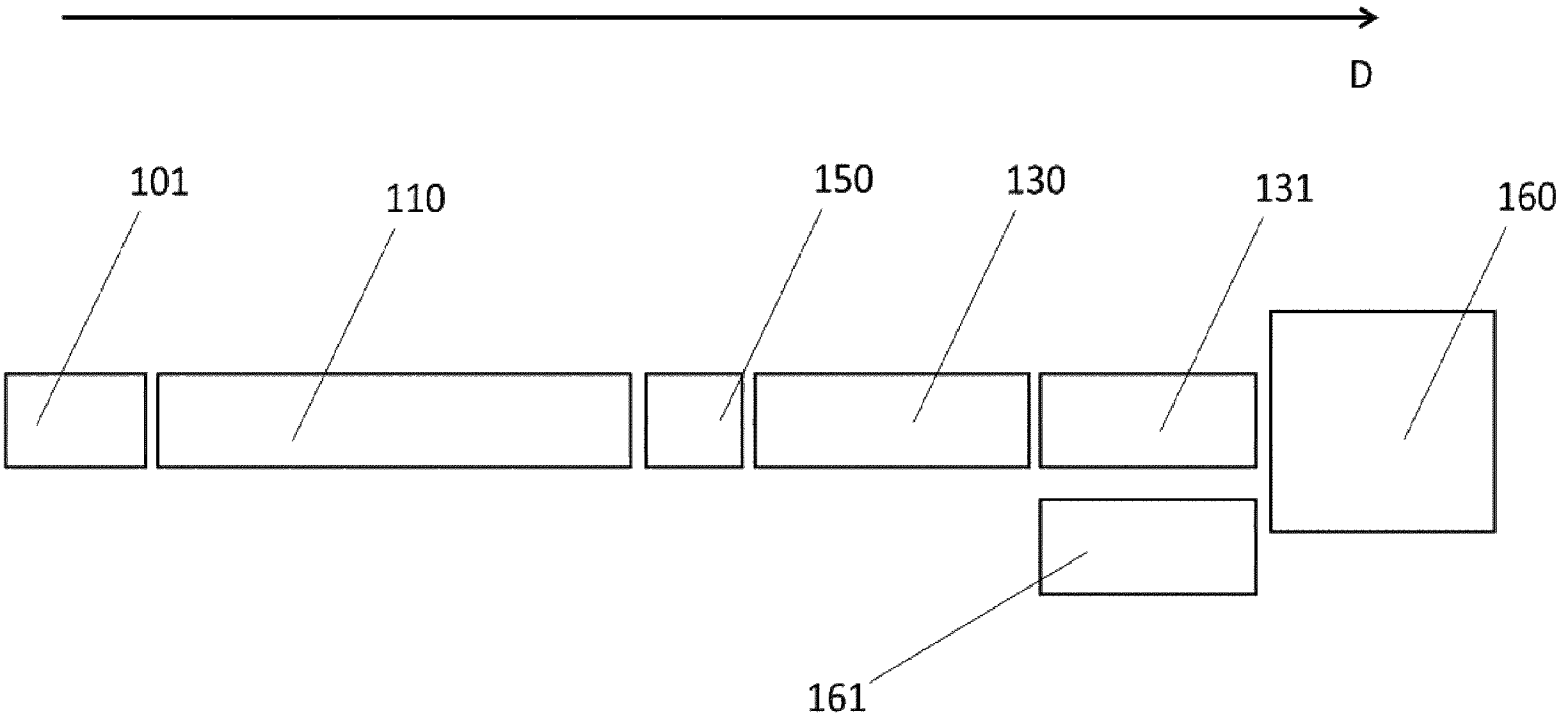
Figure 4:
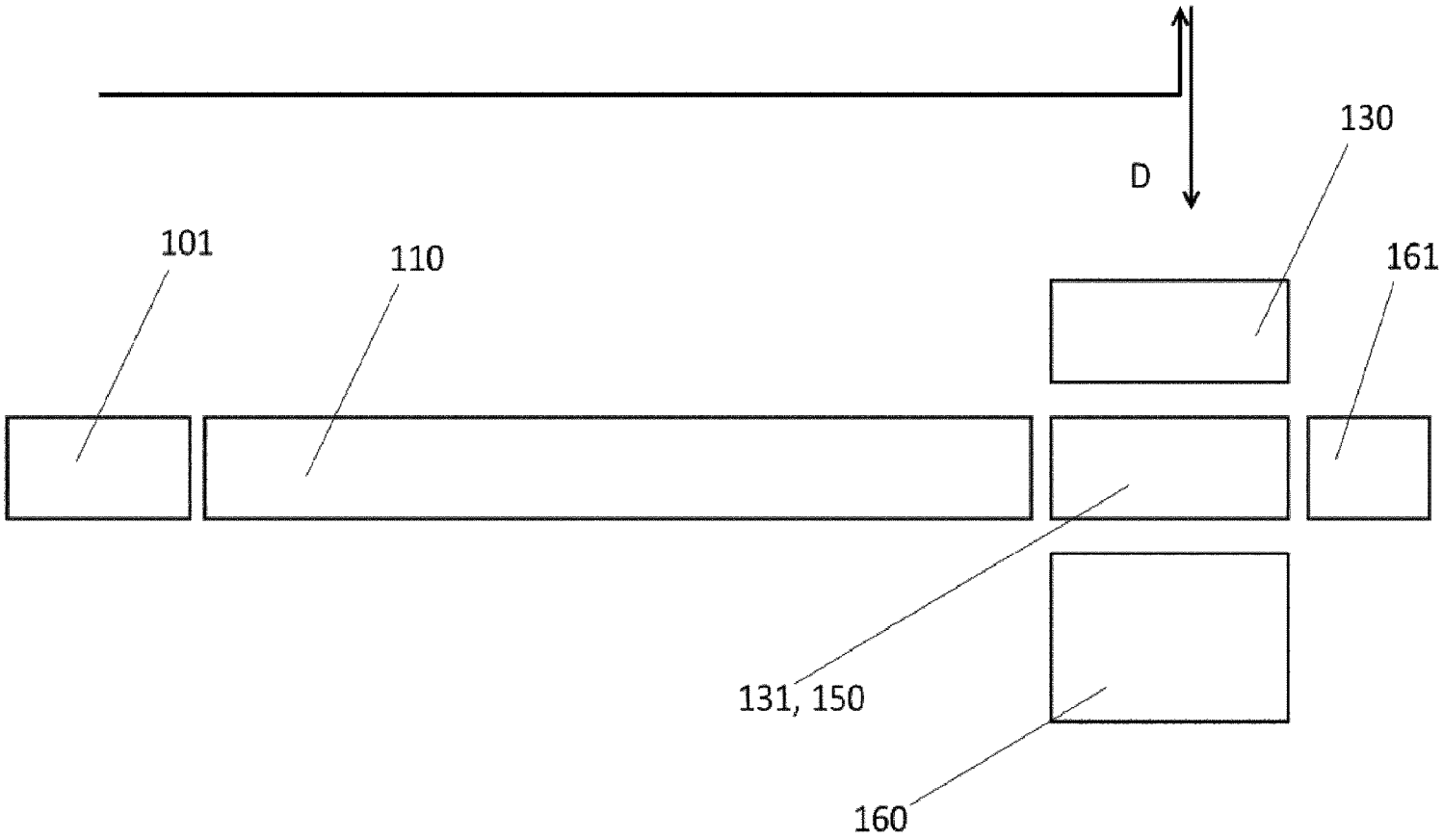
Figure 5:
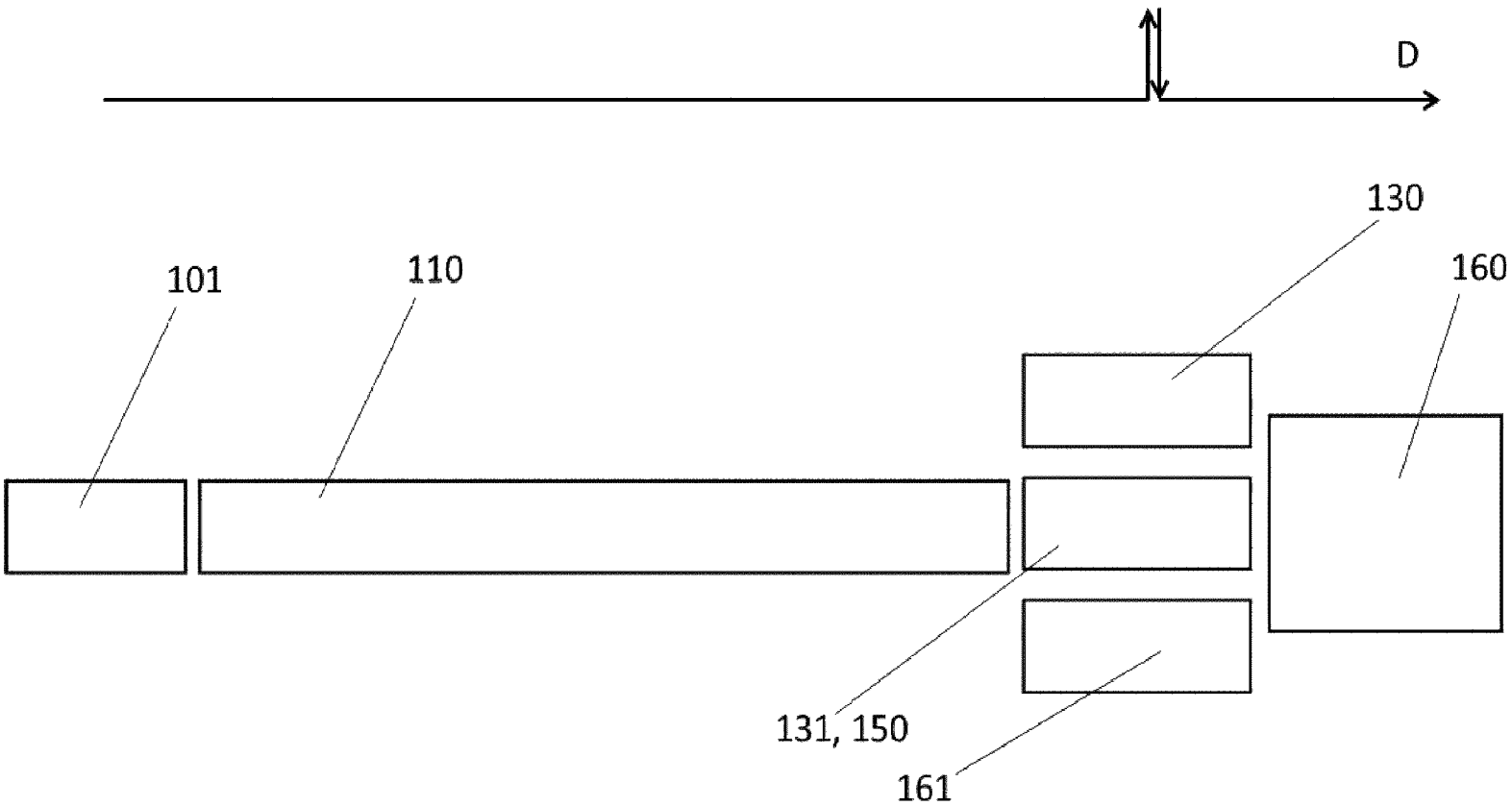
Figure 6:
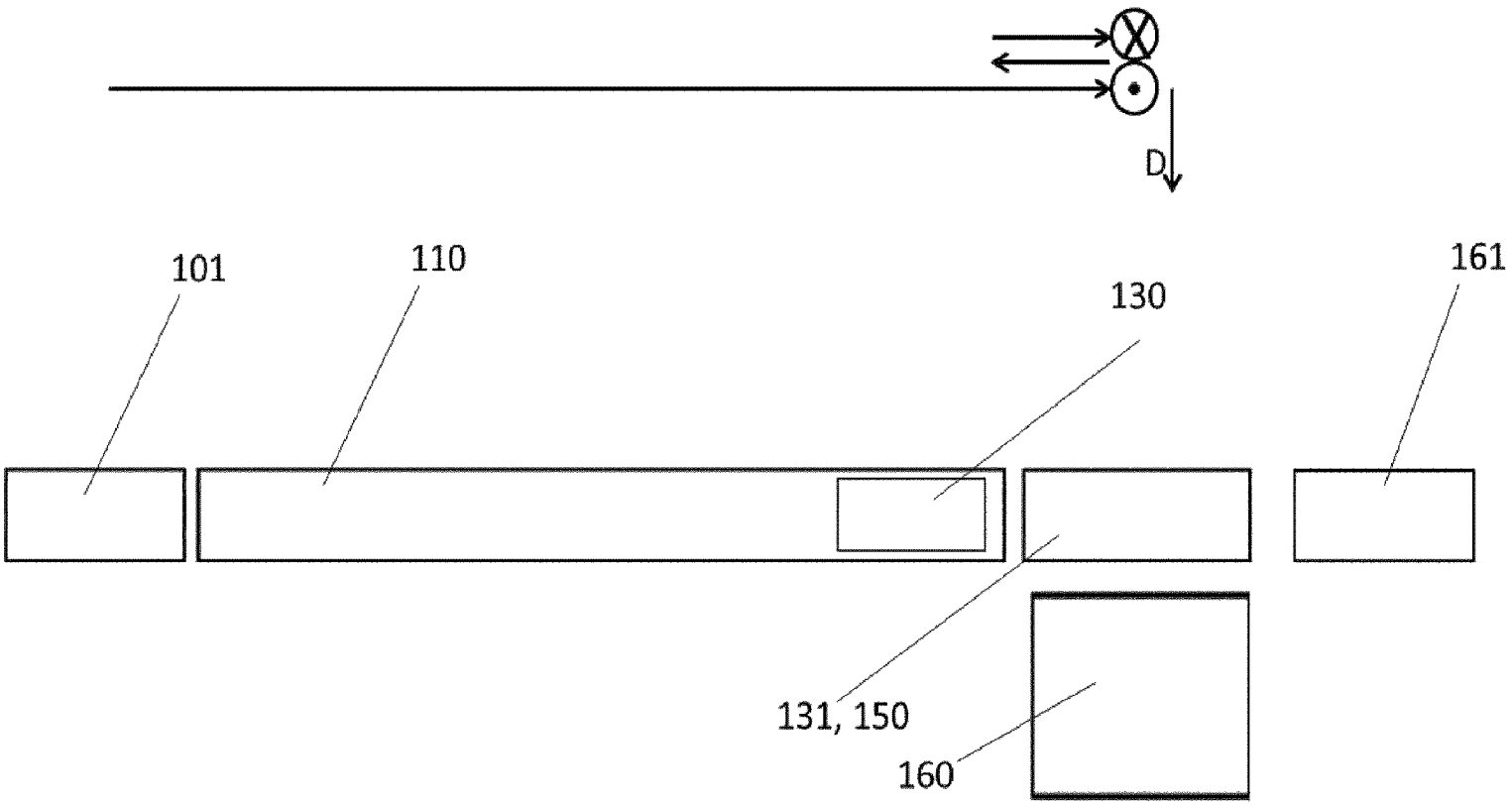
Figure 7:
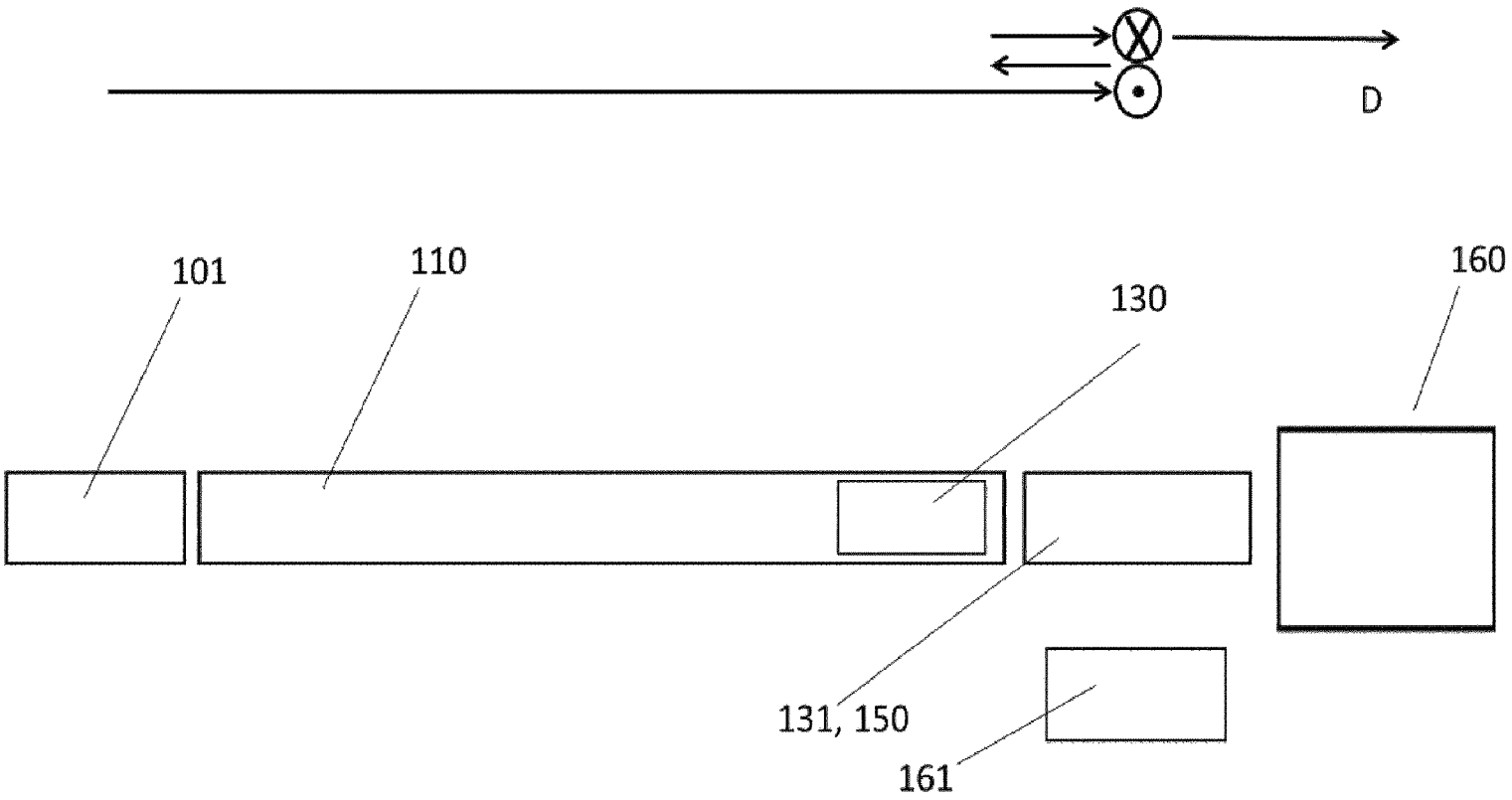

Additional advantages, features and advantageous developments of the invention can be found in the sub-claims and the following description of preferred embodiments on the basis of the figures, in which:

FIG. 1 shows a typical temperature curve when heat-treating a steel component having a first and a second region, FIG. 2 is a schematic plan view of a thermal heat-treatment device according to the invention, FIG. 3 is a schematic plan view of another thermal heat-treatment device according to the invention, FIG. 4 is a schematic plan view of another thermal heat-treatment device according to the invention, FIG. 5 is a schematic plan view of another thermal heat-treatment device according to the invention, FIG. 6 is a schematic plan view of another thermal heat-treatment device according to the invention, and FIG. 7 is a schematic plan view of another thermal heat-treatment device according to the invention.

FIG. 1 shows a typical temperature curve when heat-treating a steel component 200 comprising a first region 210 and a second region 220 according to the method of the invention. According to the schematically drawn temperature profile $\vartheta_{200,110}$, the steel component 200 is heated in the first furnace 110 during the dwell time thereof in the first furnace $t_{110}$ to a temperature that is above the Ac3 temperature. The steel component 200 is then transferred to the treatment station 150 for a transfer time $t_{120}$. In this case, the steel component loses heat. In the treatment station, a second region 220 of the steel component 200 is quickly cooled, the second region 220 losing heat quickly according to the profile $\vartheta_{220,150}$ drawn. Cooling ends once the treatment time $t_B$, which only lasts for a few seconds depending on the thickness of the steel component 200, the desired material properties and the size of the second region 220, has elapsed. In a first approximation, the treatment time $t_B$ equals the dwell time $t_{150}$ in the treatment station 150 in this case. The second region 220 has then reached the cooling stop temperature $\vartheta_2$ that is above the martensite start temperature $M_S$. At the same time, the temperature of the first region 210 in the treatment station 150 has also decreased according to the temperature profile $\vartheta_{210,150}$, whereby the first region 210 is not in the region of the cooling apparatus. Once the treatment time $t_B$ has elapsed, the steel component 200 is transferred to the second furnace 130 during the transfer time $t_{121}$, whereby it loses more heat if its temperature is greater than the internal temperature $\vartheta_4$ of the second furnace 130. In the second furnace 130, the temperature of the first region 210 of the steel component 200 changes according to the schematically drawn temperature profile $\vartheta_{210,130}$ during the dwell time $t_{130}$, i.e. the temperature of the first region 210 of the steel component 200 slowly continues to decrease. In this case, the temperature of the first region 210 of the steel component 200 can fall below the Ac3 temperature, but does not have to. On the contrary, the temperature of the second region 220 of the steel component 200 once again increases during the dwell time $t_{130}$ according to the temperature profile $\vartheta_{220,130}$ drawn, without reaching the Ac3 temperature. The second furnace 130 does not comprise any special devices for treating the different regions 210, 220 differently. Only one furnace temperature $\vartheta_4$, i.e. a substantially homogeneous temperature in the entire interior of the second furnace 130, is set and is between the austenitizing temperature Ac3 and the cooling stop temperature $\vartheta_2$, for example between 660° C. and 850° C. The different regions 210, 220 therefore approach the internal temperature $\vartheta_4$ of the second furnace 130. Provided that the drop in temperature in the first region 210 during the dwell time $t_{150}$ in the treatment station 150 are small enough for the second region 220 that the temperature does not fall below the temperature $\vartheta_4$ of the second furnace 130, the temperature profile $\vartheta_{210,130}$ of the first region approaches the temperature $\vartheta_4$ of the second furnace 130 from above. In this embodiment, the cooling stop temperature $\vartheta_2$ is lower than the temperature $\vartheta_4$ selected for the second furnace 130. The temperature profile $\vartheta_{220,130}$ of the second region approaches the temperature $\vartheta_4$ of the second furnace 130 from below. The temperature of the region 210 does not fall below the structure transformation start temperature $\vartheta_1$. As a result of the small temperature difference between the two regions 210, 220, clearly contoured boundaries of the individual regions 210, 220 can be formed and the warpage of the steel component 200 is minimized. Small expansions in the temperature of the steel component 200 have an advantageous effect when further processing said component in the press-hardening die 160. The dwell time $t_{130}$ required for the second region 220 can be established on the basis of the length of the steel component by setting the conveying speed and the dimensions of the length of the second furnace 130. The cycle time of the heat-treatment device 100 is thereby minimally affected, or even not at all. The first region 220 of the steel component 200 dissipates heat in the second furnace 130. The second region 220 of the steel component 200 absorbs heat in the second furnace 130, with the heat absorption being restricted by the heat released in the second region 220 of the steel component 200 during the recalescence of the structure. Overall, this only requires a relatively small amount of heating power in the second furnace 130. Additional heating of the second furnace 130 can optionally be omitted altogether. This treatment step is therefore particularly energy-efficient.

Once the dwell time $t_{130}$ of the steel component 200 in the second furnace 130 has finished, said component is transferred to a press-hardening die 160 during the transfer time $t_{131}$, where it is reshaped and hardened during the dwell time $t_{160}$.

FIG. 2 shows a heat-treatment device 100 according to the invention in a 90° arrangement. The heat-treatment device 100 comprises a loading station 101, by means of which steel components are fed to the first furnace 110. Furthermore, the heat-treatment device 100 comprises the treatment station 150 and, arranged therebehind in the main direction of flow D, the second furnace 130. Arranged further downstream thereof in the main direction of flow D is a removal station 131, which is equipped with a positioning device (not shown). The main direction of flow then deviates by substantially 90°, in order to allow a press-hardening die 160 in a press (not shown) to follow, in which die the steel component 200 is press-hardened. A container 161, in which rejects can be placed, is arranged in the axial direction of the first furnace 110 and of the second furnace 130. In this arrangement, the first furnace 110 and the second furnace 120 are preferably formed as continuous furnaces, for example roller hearth furnaces.

FIG. 3 shows a heat-treatment device 100 according to the invention in a linear arrangement. The heat-treatment device 100 comprises a loading station 101, by means of which steel components are fed to the first furnace 110. The heat-treatment device 100 also comprises the treatment station 150 and, arranged downstream thereof in the main direction of flow D, the second furnace 130. Arranged further downstream thereof in the main direction of flow D is a removal station 131, which is equipped with a positioning device (not shown). A press-hardening die 160 in a press (not shown), in which the steel component 200 is press-hardened, then follows in the main direction of flow that now continues straight. Arranged at substantially 90° to the removal station 131 is a container 161, in which rejects can be placed. In this arrangement, the first furnace 110 and the second furnace 120 are also preferably formed as continuous furnaces, for example roller hearth furnaces.

FIG. 4 shows another variant of a heat-treatment device 100 according to the invention. The heat-treatment device 100 again comprises a loading station 101, by means of which steel components are fed to the first furnace 110. In this embodiment, the first furnace 110 is again preferably formed as a continuous furnace. Furthermore, the heat-treatment device 100 comprises the treatment station 150, which is combined with a removal station 131 in this embodiment. The removal device 131 can comprise a gripping device (not shown), for example. The removal station 131 removes the steel components 200 from the first furnace 110 by means of the gripping device, for example. The second region or second regions 200 is/are heat-treated and cooled and the steel component or the steel components 200 are loaded in a second furnace 130 that is arranged at substantially 90° to the axis of the first furnace 110. In this embodiment, this second furnace 130 is preferably provided as a chamber furnace, for example comprising a plurality of chambers. Once the dwell time $t_{130}$ of the steel components 200 in the second furnace 130 has elapsed, the steel components 200 are removed from the second furnace 130 via the removal station 131 and placed in an opposite press-hardening die 160 that is installed in a press (not shown). For this purpose, the removal station 131 can comprise a positioning apparatus (not shown). A container 161 is arranged downstream of the removal station 131 in the axial direction of the first furnace 110, in which container rejects can be placed. In this embodiment, the main direction of flow D describes a deflection of substantially 90°. In this embodiment, a second positioning system for the treatment station 150 is not required. Furthermore, this embodiment is advantageous when there is not enough space available in the axial direction of the first furnace 110, for example in a production hall. In this embodiment, the second regions 220 of the steel component 200 can also be cooled between the removal station 131 and the second furnace 130 so that a stationary treatment station 150 is not required. For example, a cooling device, for example a blowing nozzle, can be integrated in the gripping device. The removal device 131 ensures that the steel component 200 is transferred from the first furnace 110 to the second furnace 130 and to the press-hardening die 160 or to the container 161.

In this embodiment, too, the press-hardening die 160 and the container 161 can switch positions, as can be seen in FIG. 5. In this embodiment, the main direction of flow D describes two deflections of substantially 90°.

If the space in which the heat-treatment device is to be placed is restricted, a heat-treatment device according to FIG. 6 is advantageous: in comparison with the embodiment shown in FIG. 4, the second furnace 130 is moved to a second plane above the first furnace 110. In this embodiment, too, the second regions 220 of the steel component 200 can likewise be cooled between the removal station 131 and the second furnace 130, so that a stationary treatment station 150 is not required. Once again it is advantageous for the first furnace 110 to be formed as a continuous furnace and for the second furnace 120 to be formed as a chamber furnace, possibly comprising a plurality of chambers.

Lastly, FIG. 7 is a schematic view of a final embodiment of the heat-treatment device according to the invention. In comparison with the embodiment shown in FIG. 6, the press-hardening die 160 and the container 161 have switched positions.

The embodiments shown here only represent examples of the present invention and should therefore not be understood to be limiting. Alternative embodiments that a person skilled in the art would take into consideration are likewise covered by the scope of protection of the present invention.

LIST OF REFERENCE SIGNS

100 heat-treatment device
110 first furnace
130 second furnace
131 removal station
150 treatment station
160 press-hardening die
161 container
200 steel component
210 first region
220 second region
D main direction of flow
$M_S$ martensite start temperature
$t_B$ treatment time
$t_{110}$ dwell time in the first furnace
$t_{120}$ transfer time of the steel component to the treatment station
$t_{121}$ transfer time of the steel component to the second furnace
$t_{130}$ dwell time in the second furnace
$t_{131}$ transfer time of the steel component to the press-hardening die
$t_{150}$ dwell time in the treatment station
$t_{160}$ dwell time in the press-hardening die
$\vartheta_1$ structure transformation start temperature
$\vartheta_2$ cooling stop temperature
$\vartheta_3$ internal temperature of the first furnace
$\vartheta_4$ internal temperature of the second furnace
$\vartheta_{200,110}$ temperature profile of the steel component in the first furnace
$\vartheta_{210,150}$ temperature profile of the first region of the steel component in the treatment station
$\vartheta_{220,150}$ temperature profile of the second region of the steel component in the treatment station
$\vartheta_{210}$, $\vartheta_{130}$ temperature profile of the first region of the steel component in the second furnace
$\vartheta_{220,130}$ temperature profile of the second region of the steel component in the second furnace
$\vartheta_{200,160}$ temperature profile of the steel component in the press-hardening die

The invention claimed is:

1. A method comprising heat-treating individual zones of a steel component, which is usable for a vehicle component, to form a primarily austenitic structure in one or more first regions of the steel component, from which structure a predominantly martensitic structure can be produced by means of quenching, and to form a predominantly bainitic structure in one or more second regions, wherein heat-treating the zones comprises: first heating the steel component to a temperature above the Ac3 temperature in a first furnace, transferring the entire steel component to a treatment station wherein said component is cooled down during the transfer, cooling the one or more second regions of the steel component to a cooling stop temperature $\Theta_2$ in the treatment station during a treatment time $t_B$, and transferring the entire steel component to a second furnace, the temperature of the one or more second regions increasing to a temperature below the Ac3 temperature again, wherein a temperature of the second furnace is set between 660 and 850° C.

2. The method according to claim 1, wherein the cooling stop temperature $\Theta_2$ is selected to be above the martensite start temperature $M_S$.

3. The method according to claim 1, wherein the cooling stop temperature $\Theta_2$ is selected to be below the martensite start temperature $M_S$.

4. The method according to claim 1, wherein a heat supply is used to increase the temperature at the second region or second regions of the steel component in the second furnace.

5. The method according to claim 1, wherein the internal temperature of the second furnace $\Theta_4$ is greater than the cooling stop temperature $\Theta_2$.

* * * * *